United States Patent [19]

Sowash

[11] Patent Number: 5,016,538

[45] Date of Patent: May 21, 1991

[54] SABOT BULLET

[75] Inventor: Robert P. Sowash, Soquel, Calif.

[73] Assignee: Olin Corporation, Stamford, Conn.

[21] Appl. No.: 397,363

[22] Filed: Aug. 22, 1989

Related U.S. Application Data

[63] Continuation of Ser. No. 246,898, Sep. 16, 1988, abandoned, which is a continuation of Ser. No. 31,721, Mar. 30, 1987, abandoned.

[51] Int. Cl.[5] ..... F42B 14/06

[52] U.S. Cl. ..... 102/520; 102/439; 102/501

[58] Field of Search ..... 102/439, 448, 501, 517, 102/520–523

[56] References Cited

U.S. PATENT DOCUMENTS

| | | | |
|---|---|---|---|
| 3,726,231 | 4/1973 | Kelly et al. | 102/522 |
| 3,814,019 | 6/1974 | Hines, Jr. | 102/501 |
| 3,927,618 | 12/1975 | Engel | 102/523 |
| 4,005,660 | 2/1977 | Pichard | 102/501 |
| 4,048,922 | 9/1977 | Buljovcic | 102/439 |

FOREIGN PATENT DOCUMENTS

| | | | |
|---|---|---|---|
| 2313656 | 12/1976 | France | 102/501 |
| 347979 | 7/1937 | Italy | 102/501 |
| 1041865 | 9/1983 | U.S.S.R. | 102/501 |
| 1068694 | 1/1984 | U.S.S.R. | 102/501 |

*Primary Examiner*—Charles T. Jordan
*Assistant Examiner*—Richard W. Wendtland
*Attorney, Agent, or Firm*—John R. Wahl

[57] ABSTRACT

A sabot bullet having a bullet body and sabot segments defining an outer cylindrical surface in surrounding relationship to the bullet body. The bullet body has a pair of spaced conical parts interconnected by a central part of cylindrical configuration. The central part increases the strength of the bullet body and assures that the bullet body will not break at the central part during penetration of the bullet body in a target. Another embodiment of the sabot bullet includes a bullet body having a front part of metallic material and a rear part of a second material, such as plastic or the like. The second part, being lighter in weight than the first part, reduces the overall weight of the bullet body to assure a higher velocity of travel of the bullet body with greater accuracy due to its lighter weight. An armor piercing sabot bullet is also disclosed.

1 Claim, 2 Drawing Sheets

SABOT BULLET

This is a Continuation of application Ser. No. 246,898, filed Sept. 16, 1988, now abandoned which was an FWC of Ser. No. 031,721, filed Mar. 30, 1987, now abandoned.

This invention relates to improvements in sabot bullets and, more particularly, to an improved bullet body for such a bullet.

Sabot bullets have been known and used in the past for a number of years. A disclosure relating to such a bullet includes U.S. Pat. No. 3,726,231. In that disclosure, a sabot bullet is described in which the bullet body of the sabot bullet has two conical parts which are found together integral with and converge to each other and diverge outwardly as the parts extend away from their junction. While this construction of a sabot bullet body has been satisfactory in many instances, is also proven to be a drawback inasmuch as the bullet body has a tendency to break at the junction. This thereby minimizes the penetration of the bullet body in a target which is struck by the bullet body after being shot from a shot gun. Because of this problem, a need exists for improvements in the construction of the bullet body. The present invention satisfies this need.

SUMMARY OF THE INVENTION

The present invention is directed to an improved sabot bullet having a bullet body which is increased in size in the area at which the two conical parts of the bullet body are joined. Instead of joining the conical parts together to each other, a means is provided which extends longitudinally of the bullet body and is integral with the adjacent ends of the conical parts so that the conical parts can be separated from each other and the region therebetween can be strengthened to thereby minimize or eliminate any tendency for the bullet body to shear or break at the region between the conical end parts. Maintaining the bullet body in one piece is essential for accuracy. provides for greater penetration of the bullet body into a target and is especially suitable for shot guns with full choke bores which would otherwise operate to weaken the bullet body as it leaves the barrel of the shot gun after being shot therefrom.

Another embodiment of the bullet body of the present invention includes a front part of a first, metallic material and a rear part of a second, lighter weight material, such as plastic or the like. The second part eliminates the drilling and plugging of the first part and provides a lighter weight for the overall bullet body itself, and enhanced forward positioning of the center of gravity, resulting in a higher velocity of travel after being fired and more stability and accuracy in flight.

The primary object of the present invention is to provide an improved sabot bullet in which the body of the sabot bullet is strengthened at the region of smallest diameter to thereby minimize or substantially eliminate the problems due to breaking of the body in such region, all of which is accomplished without effecting its aerodynamic and target-penetration capabilities.

Another object of the present invention is to provide a sabot bullet of improved construction which has a front part of metallic material and a rear part of lighter weight material, such as plastic to thereby eliminate drilling and plugging of the bullet body and to result in a higher velocity of the bullet when shot from a shot gun and to provide good aerodynamic stability and accuracy when the sabot bullet is in flight.

Another object of the present invention is to provide a one-piece segmented sabot which uses a teeter totter separation principle resulting in more uniform separation by using airflow to open the segment in a manner similar to flower petals.

Other objects of this invention will become apparent as the following specification progresses, reference being handed the accompanied drawings for illustration of the invention.

IN THE DRAWING

Figure 1:
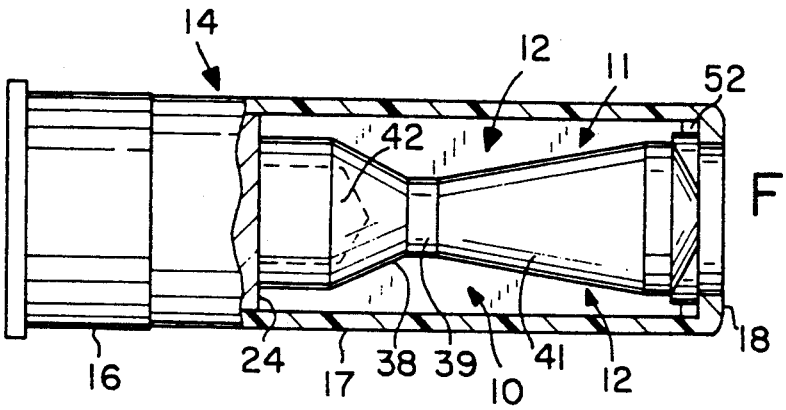
FIG. 1 is a side elevational view of a conventional shotgun shell having the improved sabot bullet of the present invention mounted therein.

The present invention provides a sabot bullet assembly 10 (FIG. 2) having a bullet body 11 and a pair of sabot segments 12. The segments 12 are adapted to embrace and thereby enclose bullet body 11 in the manner shown in FIG. 1. The bullet, when so assembled, is adapted to be placed in a conventional shot gun shell 14 (FIG. 1).

Shell 14 includes a cylindrical base 16 and a tubular body 17 terminating at its forward end with an inwardly crimped curl 18 which holds the bullet in the tubular body 17. Bullet 10 is forwardly of the wad 24 of shell 14, the wad transfers the explosive charge force of shell 14 to bullet 10, causing it to be projected forwardly and out of tubular body 17 and into the air along a specific trajectory.

The length of sabot bullet 10 is such that body 11 and sabot segments 12 extend between the forward, flat face of wad 24 and the curl 18 as shown in FIG. 1.

Figure 2:
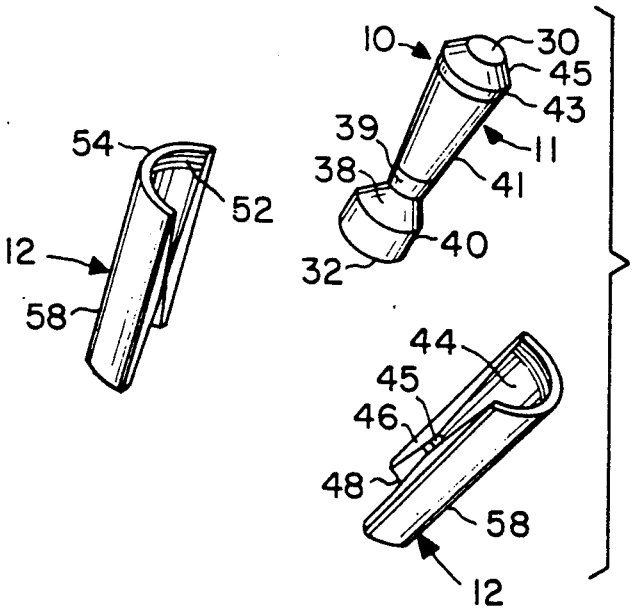
FIG. 2 is an exploded, perspective view of the sabot bullet showing the bullet body and the sabot segments separated from each other.

Body 11 of sabot bullet 10 is of one piece construction and has a front, circular, flat end face 30 and a base 32 of cylindrical shape (FIG. 2). Body 11 further includes a cylindrical part 40, a conical part 38 having a conical outer surface which converges to a cylindrical central part 39 at one end of a second conical member 41 having a conical outer surface. Member 41 extending to a cylindrical part 43 at the end of a third conical part 45 opposite to the end corresponding to end face 30.

The center of gravity of the body 11 is positioned forwardly of the center of geometric mass thereof. Preferably, the rear end portion of the bullet is hollow, and a plug 42 of suitable material is inserted in the hollow end of the body. Such a plug can be of plastic, wood, metal, or other material.

Each of sabot segments 12 extends about bullet body 11 for about one half the circumference of the bullet body. Both sabot segments have cylindrical outer surfaces which mate to present a cylindrical outer surface for sabot bullet 10. This cylindrical outer surface snuggly fits within the cylindrical inner surface of shell 17 (FIG. 1). The inner surface of each of the segments matches and is complimentary to the adjacent outer surface portions of bullet body 11 as shown in FIG. 1. To this end, each sabot segment 12 has a forward tapered portion 44 for mating with conical part 41 of body 11, a cylindrical surface 45 for mating with cylindrical surface 39 of body 11, a conical surface 46 for mating with the outer surface of conical part 38, and cylindrical surface 48 for mating with a cylindrical part 40 of base 32.

The forward end portions of segments 12 are provided with shoulders 52, thus radially spacing the front end 54 of each segment 12 from the frusto-conical nose part 45 of bullet body 11.

In use, conical bullet 10 is placed in shell 14 and the shell is placed in a shot gun. When the shell is fired, bullet 10 leaves shell 17, causing the sabot segments 12 to spread apart and to separate from bullet body 11 in flight. The bullet body then continues by itself toward the target.

Figure 3:
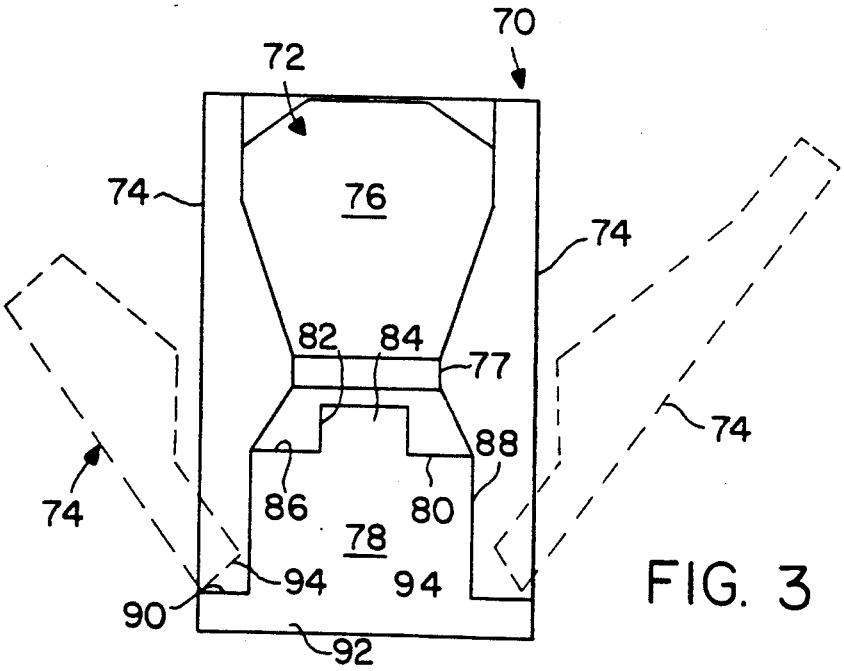
FIG. 3 is a second embodiment of the improved sabot of the present invention.

The cylindrical part 39 of bullet body 11 provides an improvement over prior art sabot bullets because part 39 provides for a stronger construction for body 11 and minimizes the tendency for the body to break at its narrowest portion, a result which has occurred all too often when conventional sabot bullet bodies are used. The construction of the body 11 provides that sabot bullet 10 is more suitable for shot guns having a full choke or open bores. Another embodiment of the sabot bullet of the present invention is shown in FIG. 3 and broadly denoted by the numeral 70. Bullet 70 includes a bullet body 72 and a pair of sabot segments 74 which have cylindrical outer surfaces and which mate to surround bullet body 72 in a manner described above with respect to the sabot segments 12 which surround bullet body 11.

Bullet body 72 has a front part 76 and a rear part 78 which mate together to form bullet body 72. Part 76 is formed from a suitable metallic material, such as lead; whereas, part 78 is formed from a relatively light weight material, such plastic. An epoxy or other thermoplastic material is suitable for this use. Front part 76 has a central cylindrical part 77 for the same reason as part 39 of bullet 10.

Part 76 has a rear annular end face 80 which surrounds a recess 82. The recess 82 is filled with a projection 84 integral with part 78 which also has a front, flat, annular face 86 which mates with and engages end face 80 of part 76. Rear part 78 has a cylindrical outer surface 88 which terminates at an annular shoulder 90 on an annular section 92 at the rear end of and integral with part 78. The semi-circular end faces 94 on sabot segments 74 are supported on and engage annular surface 90 so that the surface provides pivot points for the sabot segments 74 as the same separate from bullet body 72 during flight of bullet 70 through the air after bullet 80 has been projected through the air from a shell casing, such as the shell casing 17 shown in FIG. 1.

In use, bullet 70 is placed in a shell casing, such as casing 17 (FIG. 1). Then the shell is placed in a shot gun and the shell is fired, causing bullet 70 to be projected through the air along a trajectory. As the bullet moves through the air, sabot segments 74 separate from bullet body 72 by pivoting off surface 90 as a pivot point.

The use of part 78 coupled with part 76 to form bullet 72 eliminates drilling and plugging of the base of part 76. It provides a lighter weight for bullet body 72 which results in a higher velocity of travel of the bullet body and a more stable or more accurate movement of the bullet body to the target.

Figure 4:
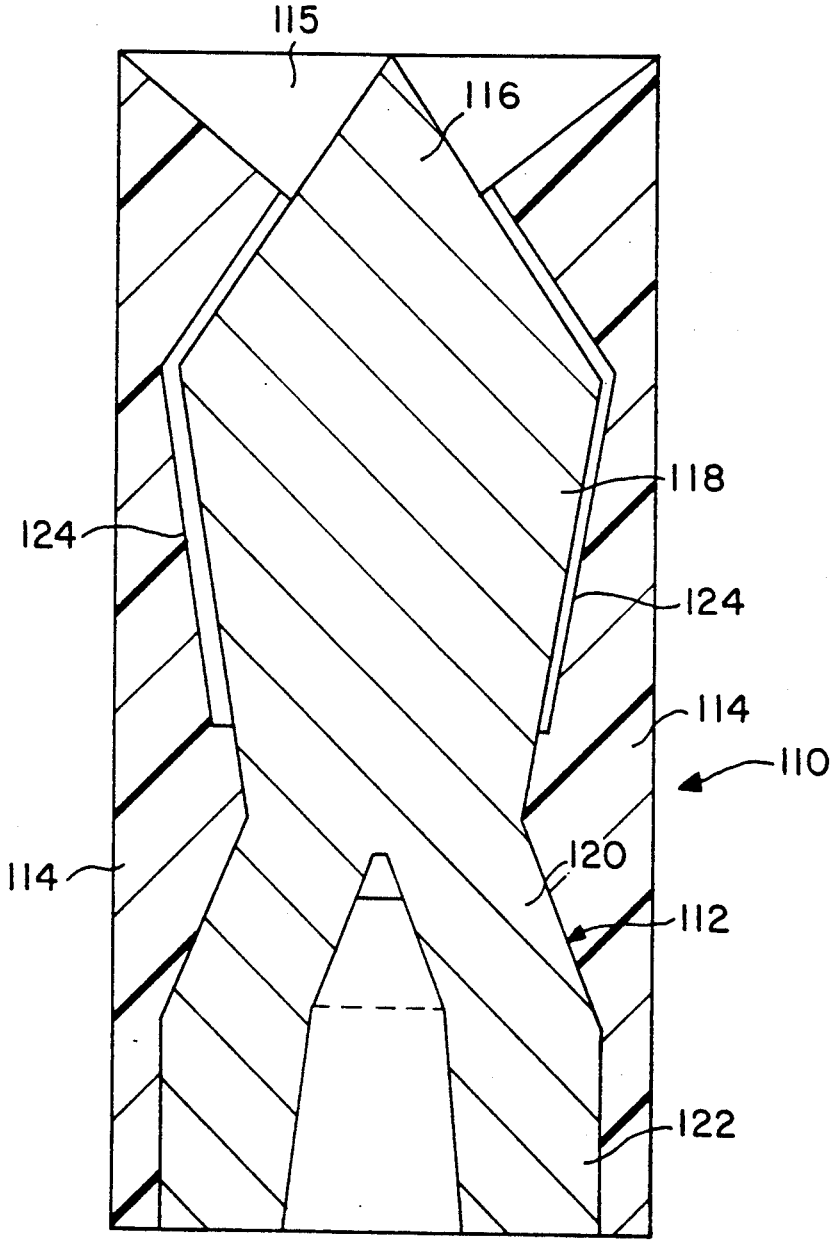
FIG. 4 is a view similar to FIG. 3 but showing an armor piercing sabot bullet.

An armor piercing sabot bullet 110 is shown in FIG. 4. It includes a bullet body 112 and a pair of sabot segments 114 which embrace bullet body 112, such as when the sabot bullet 110 is in a conventional shotgun shell 14 as shown in FIG. 1. Bullet body 110 has a pointed front end 116 which is conical in configuration, the pointed front end 116 being coupled to an intermediate portion 118 which circular in cross-section. Bullet body 112 further includes a third, frusto-conical part 120 and a forth part 122 which is an extension of part 120.

The sabot segments 114 are cut away at their front ends to form a conical recess 115. This recess receives air when the bullet emerges from a gun barrel after being fired and the air strips the sabot segments off body 112 much faster then if the recess were not present. Sabot segments 114 have air passages 124 on their inner surfaces to assist in stripping the sabot segments 114 from body 112. The passages 124 extend from locations near intermediate portion 118 to and communicating with recess 115. There may be one or more passages 124 for each sabot segment.

In use, when the sabot bullet 110 is fired, sabot segments 114 strip away from the bullet body 112 and the bullet body proceeds to a target. Since the pointed front end 16 is shaped as shown in FIG. 4, bullet body 112 can pierce armor of a predetermined thickness.

I claim:

1. A sabot bullet comprising:

a bullet body having an outer surface, a front part and a rear part, the front and rear parts being spaced apart from each other, each part having a conical portion and a cylindrical portion, the cylindrical portion of each part being remote from the other part, the front part being substantially solid throughout its entire length, the front part being axially longer than the rear part, said rear part having a hollow space extending inwardly from the rear end thereof, there being a plug in the space, whereby the rear part is substantially solid throughout, the conical portion of each part increasing in diameter as such conical part extends away from the other part, there being a cylindrical connecting member extending longitudinally of the bullet body for interconnecting the parts, said member being solid throughout and integral with the conical and cylindrical portions of said parts to form therewith a one-piece construction; and a number of sabot segments for engaging the bullet body and forming a shell in surrounding relationship to the bullet body, each segment having an inner surface substantially complementary to the adjacent outer surface of the bullet body, said inner surface of each segment having a cylindrical surface portion for engaging a respective cylindrical surface portion of the outer surface of the cylindrical connecting member, the outer surface of the conical parts being at respective angles sufficiently shallow relative to the longitudinal axis of the connecting member to permit the sabot segments to be readily separable from the bullet body.

* * * * *